United States Patent [19]

Backer et al.

[11] 4,425,691

[45] Jan. 17, 1984

[54] FABRIC FORMING PROCESS

[76] Inventors: Stanley Backer, 5 Irving Rd., Waban, Mass. 02168; Michael A. Zimmerman, 42 Strathmore Rd., A6, Brookline, Mass. 02146

[21] Appl. No.: 373,737

[22] Filed: Apr. 30, 1982

[51] Int. Cl.[3] ..... D04B 35/00; D03B 49/00

[52] U.S. Cl. ..... 28/166; 57/90; 57/283; 57/332; 57/334; 66/125 A

[58] Field of Search ..... 57/90, 334, 332, 334–347, 57/283, 284; 28/166; 66/125 R, 125 A, 146

[56] References Cited

U.S. PATENT DOCUMENTS

| | | | |
|---|---|---|---|
| 2,751,747 | 6/1956 | Burleson | 57/283 |
| 2,862,525 | 12/1958 | McGinley | 139/17 |
| 3,009,312 | 11/1961 | Seem et al. | 57/283 |
| 3,069,837 | 12/1962 | Olson | 57/287 |
| 3,099,907 | 8/1963 | Masurel et al. | 57/328 |
| 3,225,533 | 12/1965 | Henshaw | 57/331 X |
| 3,296,786 | 1/1957 | Wyatt | 57/309 |
| 3,298,342 | 1/1967 | Smiley et al. | 139/391 X |
| 3,327,461 | 6/1967 | Wyatt | 57/334 X |
| 3,330,104 | 7/1967 | Dunwoody, Jr. | 57/284 |
| 3,434,275 | 3/1969 | Backer et al. | 57/204 |
| 3,680,302 | 8/1972 | Hess et al. | 57/334 X |
| 3,816,993 | 6/1974 | McWaters | 57/334 X |
| 3,861,129 | 1/1975 | Doschko | 57/287 |
| 3,894,387 | 7/1975 | Boisvert | 57/332 |

FOREIGN PATENT DOCUMENTS 890053 2/1962 United Kingdom .

OTHER PUBLICATIONS

"Journal of the Textile Institute", Jun. 1970, vol. 61, No. 6, pp. 245–259.

*Primary Examiner*—John Petrakes

[57] ABSTRACT

A method of forming a fabric from yarns includes wrapping each yarn about a cylindrical pin in the feed zone of a fabric-forming machine and varying the angle of intersection of the pin with the yarn path to permit alternating real twist to pass the pin and become locked in the fabric being formed.

10 Claims, 5 Drawing Figures

FABRIC FORMING PROCESS

BACKGROUND AND BRIEF DESCRIPTION OF THE INVENTION

The present invention relates to a fabric forming process, and more particularly, to a process of imposing twist on yarn immediately upstream of a fabric forming device to introduce variations in the fabric being manufactured.

It has been conventional in the manufacture of fabrics to utilize yarns which, prior to insertion into the fabric, have either been subjected to some degree of real twist or otherwise bonded together to assure that the individual yarns can withstand the manufacturing process. However, one of the drawbacks involved in such prior art processes has resulted from the use of a binder with which the yarn strands are impregnated. However, as noted in U.S. Pat. No. 3,099,907, the use of a binder in the yarns reduces the field of application of the yarn since the surface characteristics are affected, thus restricting the application of the yarns and fabrics where the feel of the fabric is an important consideration in terms of its marketability. Moreover, the use of a binder often requires its subsequent removal in the process which can materially increase the cost of manufacture of the fabric.

While one method of eliminating the necessity of using a binder is suggested in U.S. Pat. No. 3,099,907, mentioned above, which involves the use of a false twist device immediately upstream of the fabric forming machine, the use of such devices is cumbersome and expensive both in terms of power consumption and maintenance, on the one hand, and on the other, unacceptable downtime is required when any change is desired in the twist that is to be imposed in the yarns being fed to the fabric-forming machine.

The present invention has for its object the provision of a fabric-forming where alternating real twist can be inserted in the yarn being fed to the fabric-forming device so that a variety of interesting fabric effects can be achieved at a very low cost both in terms of installation and maintenance of the device. Also, a particular advantage of the present invention is that the twist insertion device requires little or no power to operate, unlike the false twisting devices such as the rotating spindles, friction discs, or the like in prior art false twist arrangements.

In some prior art arrangements, cylindrical pins have been used to insert twist in a moving yarn strand. While these devices have been successful, particularly in the false twist texturing of synthetic thermoplastic filaments, they have all essentially operated on the basis that the pin is set at a fixed angle with respect to the yarn path, which angle is not varied during the operation.

The present invention takes advantage of the unique properties of a cylindrical pin and its interaction with a yarn where the yarn is wrapped about the pin and translated relative thereto as it has been found that the amount of twist that builds up and which slips past the pin is sensitive to the angle of intersection and particularly to variations in the angle which may be momentarily or continually varied so that the yarn twist that builds up will depend on the transient condition of the angle of intersection relative to the yarn path. It has been found, in particular, that the transient nature of the operation results in a sequential flow of finite lengths of alternating twist in the yarn which, when properly handled downstream of the pin, will appear in the resulting fabric as alternating segments that are locked in the fabric as the fabric is being produced. Since yarn twist is known to affect fabric appearance, porosity, surface texture, bending, rigidity, shrinkage and mechanical aesthetics, the provision of varying twist control of yarns being fed into a fabric will offer the manufacturer an important additional controllable parameter for fabric design and construction. Since the means for imposing twist on the yarn in the feed zone of a fabric-making machine, such as the cylindrical pin disclosed in co-pending U.S. patent application of Backer and Hsu, Ser. No. 399,127, filed July 16, 1982, requires no power consumption and a relatively small capital investment to install a very economical process is provided by the present invention which can attain novel fabric characteristics with a relatively modest cost.

In summary, the present invention contemplates providing in the feed zone of a fabric-forming machine which may be a conventional textile loom or knitting machine, a yarn twisting device in the form of a cylindrical pin, one for each yarn strand, about which each yarn strand is wrapped 360° or less and a mechanism for varying, either randomly or continually, the angle of intersection of the pin with the yarn path in a transient manner to allow alternating real twist past the pin during such transient motion of the pin whereby the twist will be inserted and locked into the fabric being formed in the loom or knitting machine. Where a plurality of yarn ends are being employed to form a fabric, the angle of intersection of the cylindrical pins for each of the yarn ends may be varied uniformly or randomly with respect to each other to produce interesting yarn effects in the resulting fabric.

The foregoing and other objects of the present invention will become apparent as consideration is given to the following detailed description taken in conjunction with the accompanying drawings, in which:

DETAILED DESCRIPTION OF THE INVENTION

Figure 1:
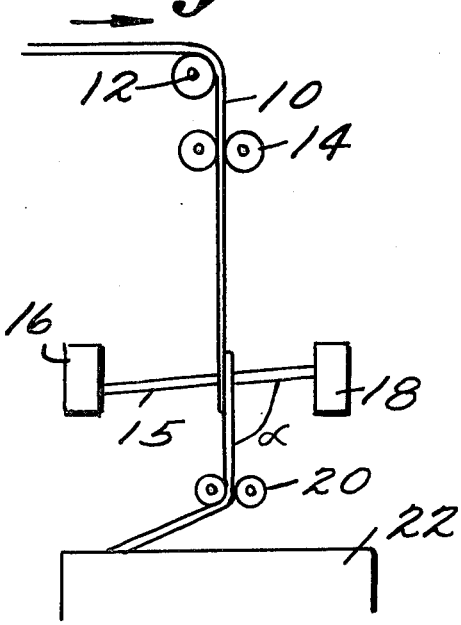
FIG. 1 is a schematic illustration of a single end of yarn being fed over the pin means of the present invention to a fabric forming machine.

Referring now to the drawings wherein like numerals designate corresponding parts throughout the several views, there is shown in FIG. 1 a schematic illustration of the apparatus and steps of the present invention where a single end of yarn 10 is taken from a supply (not shown) and fed over a guide roller 12, between tension devices 14 which may be a pair of driven rollers, Casablanca feed rolls or belts, or the like, as is well known in this art. The yarn strand 10 is then wrapped 360° or less about a smooth cylindrical pin 15 with the wrap being in the Z direction in the arrangement shown and with the longitudinal axis of the pin 15 intersecting the yarn path at an angle, $\alpha$. The opposite ends of the pin 15 are mounted in support members 16 and 18 and, as will be described in more detail later, the angle of intersection is variable to provide the novel effects of the process of the present invention.

From the cylindrical pin 15 the yarn is passed through feed rolls 20 and then to a fabric-forming machine of a conventional type which is represented schematically by the box 22.

According to the present invention, one end of the pin 15 is mounted in any suitable manner in support member 16 so as to be pivotable about an axis while the other end is mounted in the support member 18 which includes a mechanism such as gears which may be rotated to vary the angle with which the pin 15 intersects the yarn paths of the yarn 10.

As explained in more detail in co-pending application, Ser. No. 399,127, filed July 16, 1982, of S. Backer and P. Hsu, passing the yarn end 10 about a cylindrical pin which is set at an angle to the yarn path, as specified in said application, will result in twist being imposed on the yarn upstream of the pin 15 due to the frictional engagement of the yarn with the pin and the torsional path which the yarn is led to follow in moving about the pin. Such twist is false in nature in that no twist appears downstream of the pin during steady state operation since, at any given point in time, the number of turns imposed on the yarn upstream of the pin is equal and opposite to the twist in the yarn downstream of the pin. Thus, as the yarn moves past the pin 15, the twist in the yarn, in a steady state operation, cancels the downstream twist so that the yarn is in an untwisted state as it passes the pin in the direction of its travel.

According to the present invention, this phenomena is usefully employed by varying the angle of intersection $\alpha$, of the pin 15 relative to the path of the yarn 10 to obtain novel effects in the fabric being produced by the device 22. Thus, it has been found that as the angle of intersection ($\alpha$) of the pin 15 is varied, some of the twist in the yarn upstream of the pin 15 will pass the pin 15 and remain in the yarn so that the twisted portion of the yarn can be fed directly to the fabric-forming machine and the twist in the yarn will be locked in the fabric being formed.

Figure 2:
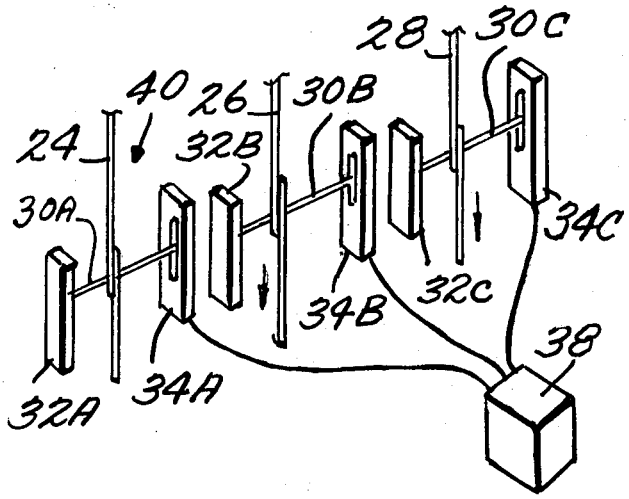
FIG. 2 is a perspective view of an arrangement where a plurality of yarn strands are fed over individual pins, the angles of intersections of which are individually controllable.

The present invention can be usefully employed with a number of different types of textile machines as it is apparent that the pin 15 and its associated support members 16 and 18 need take up very little space. In FIG. 2, for example, a plurality of yarn ends 24, 26 and 28 are shown each being wrapped around separate cylindrical pins 30A, 30B and 30C, each of which is provided with its own support members 32A–C for one end of each of the pins, and 34A–C for movably supporting the opposite ends of each pin. A common control device 38 may be provided for operating the gear mechanisms, solenoids, or the like which are mounted in the respective support members 34A–C for varying the angle of intersection of the pins 30A–B for each of the yarn ends 24, 26 and 28. While only three yarn ends are shown, it will be understood that the present invention is readily applicable to any number of yarn ends as are conventionally employed in present-day fabric-forming weaving looms and knitting machines. In this arrangement, the angles of intersection of the pins with respect to the individual yarn strands may be varied uniformly or randomly so that the yarns fed to the fabric-forming machine 22 will have substantially uniform or substantially different amounts of alternating real twist which is locked into the fabric structure by virtue of the fact that the twisted yarn is fed directly to the fabric-forming machine. This will result in interesting fabric effects in terms of texture, porosity, hand and the like which can be achieved without materially increasing the cost of manufacture or requiring unacceptable machine downtime to effect, by virtue of the very simple adjustments required, the amount of twist in the individual yarn strands. Thus, the control device 38 may be a programmable circuit which varies the angles of intersection of the respective pins according to a specified pattern or randomly, if desired.

Figure 3:
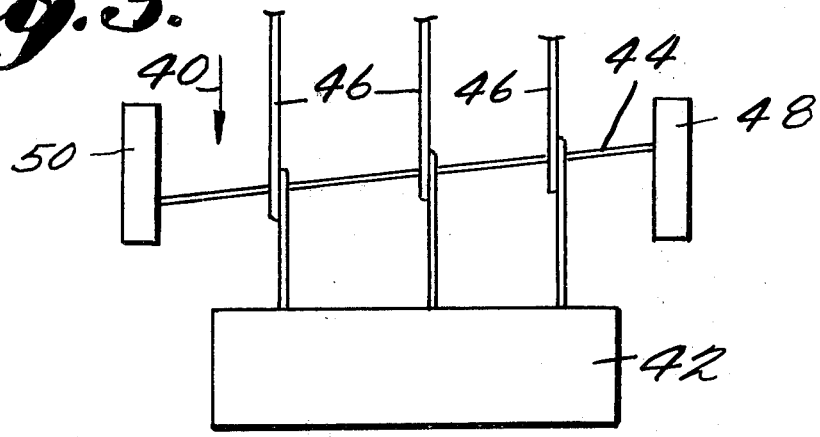
FIG. 3 is an illustration of the use of a single pin for imposing twist on a plurality of yarn ends.

As shown in FIG. 3, a single pin 44 may be employed in conjunction with several yarn strands 46 with the angle of intersection of the pin 44 being the same for each of the yarn strands. Pin 44, as in the previous embodiments, has one end mounted in a support member 50 and its opposite end mounted in a support member 48 which is of the type that can move the pin 44 to vary its angle of intersection relative to the yarn strands moving in the direction of arrow 40.

Figure 4:
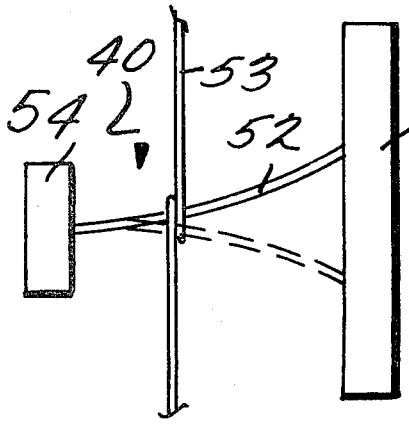
FIG. 4 is an illustration of the use of a flexible pin in the process of the present invention.

Turning now to FIG. 4, there is shown another embodiment of the present invention where a yarn end 53 is wrapped about a pin 52 which is flexible along its longitudinal axis. In this embodiment, the support member 54 rigidly holds one end of the pin 52 while the other end is mounted in the support member 56 which contains a suitable mechanism for moving the other end of the pin 52 through a limited arc to rapidly change the local angle of intersection between the pin 52 and the yarn path 53. In this regard, suitably located electrical magnets that are intermittently operated should be suitable or the previously mentioned motor-driven gear mechanism should suffice.

Figure 5:
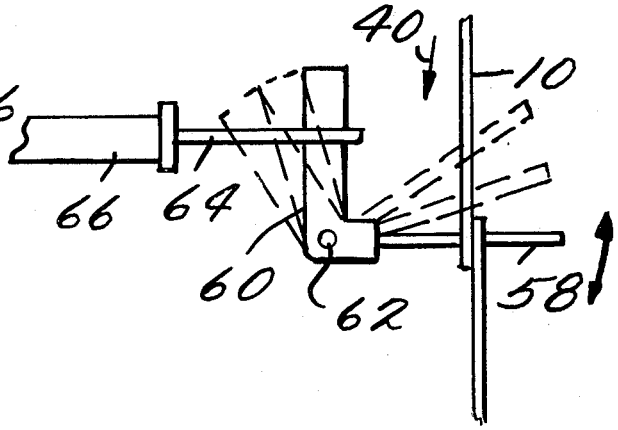
FIG. 5 is another embodiment of a means for varying the angle of intersection of the pin and yarn path in the process of the present invention.

In FIG. 5, the pin 58 is secured at one end to an armature 60 which is mounted for pitoval movement on a pin 62. At one end of the armature 60, a reciprocating link 64 is secured which is operated by an appropriate mechanism such as a solenoid 66 to effect pivoting of the armature 60 and, thus, the pin 58 about which the yarn is wrapped, as in the previous embodiments. This provides a very simple and durable means for altering the angle of intersection of the axis of the pin 58 and the path of the yarn 10 and can also be employed to vibrate the pin 58 about the pivot point 62 which can be effected by rapid actuation of th solenoid 66.

As will be apparent from the foregoing, the diameter of the pin twister of the present invention can be selected over a wide range in correspondence to the denier of the yarn being treated. For example, for 150 denier yarn, a pin twister having a diameter on the order of 0.02 inches should be suitable. In some cases, then, flexing of the pin can be effected by the random variations which occur in any running threadline or by inducing controlled variations in the yarn tension as by, for example, momentarily contacting the moving yarn, upstream or downstream of the pin, with a high friction surface or element.

Having described the invention, it will be apparent to those skilled in this art that various modifications may be made thereto without departing from the spirit and scope of the present invention as defined in the appended claims.

What is claimed is:

1. In a fabric forming process of the type including a fabric forming device and means for feeding at least one end of yarn to the device, the method comprising the steps of:

(a) wrapping the yarn about a pin means which intersects the yarn path upstream of the fabric forming device;

(b) moving the pin means while the yarn is passing therearound so that the angle of intersection of the pin means and yarn path is varied whereby twist accumulated in the yarn upstream of the pin means is permitted to pass the pin means, and (c) incorporating the yarn in a fabric with portions of the length of yarn retaining at least some of the twist that has passed the pin means.

2. The method of claim 1 including the step of moving the pin means so that the pin means intersects the yarn path at an angle greater than 90° and less than 100° as measured between the longitudinal axis of the pin and the path of the yarn downstream of the pin means.

3. The method of claims 1 or 2 including the step of intersecting the yarn path with the pin means at an angle of between 90° and 100° such that the yarn leaving the pin means contacts a section of the yarn approaching the pin means whereby a substantially increased amount of twist is imparted to the yarn upstream of the pin means.

4. The method as claimed in claim 1 including the step of imparting vibrating motion to the pin means to vary the angle at which the yarn path and the pin means intersect.

5. The method as claimed in claim 1 including the step of randomly varying the angle of intersection to introduce random variations in the amount of twist imparted to the moving yarn.

6. The method as claimed in claim 1 wherein a plurality of separate yarns are fed to the fabric forming device and a separate pin means is provided for each of said yarns and the method including the step of varying the angle of intersection of each of said pin means with respect to each of its associated yarns as each of said yarns is passed over its respective pin means.

7. The method as claimed in claim 6 including the step of varying the angles of intersection of said plurality of pin means so that, for some of the yarns, the angles of intersection are substantially the same and, for the others, the angles of intersection differ.

8. The method as claimed in claim 6 including the step of varying each of the angles of intersection in a random manner by vibrating the invididual pin means.

9. The method as claimed in claim 1 wherein said pin means is flexible along its longitudinal axis and including the step of applying a varying amount of twist to the moving yarn by flexing said pin means to vary said angle of intersection.

10. The method as claimed in claim 1 wherein said pin means is flexible along its longitudinal axis and including the step of applying a varying amount of twist to the moving yarn by inducing flexing of said pin means by varying the tension of the yarn in the thread path.

* * * * *